US005158346A

United States Patent [19]

Marks et al.

[11] Patent Number: 5,158,346

[45] Date of Patent: Oct. 27, 1992

[54] PLASTIC ACCESS PANEL FOR A DISHWASHER

[75] Inventors: Larry D. Marks, St. Joseph Township, Berrien County; James L. Engle, Watervliet Township, Berrien County, both of Mich.

[73] Assignee: Whirlpool Corporation, Benton Harbor, Mich.

[21] Appl. No.: 635,368

[22] Filed: Dec. 28, 1990

[51] Int. Cl.[5] ..... A47B 17/04

[52] U.S. Cl. ..... 312/204; 312/228

[58] Field of Search ..... 312/204, 228, 234, 253, 312/265.6; 40/611, 649, 653, 654, 490, 642, 643; 134/113; 16/268; 52/476

[56] References Cited

U.S. PATENT DOCUMENTS

| | | | |
|---|---|---|---|
| 1,537,899 | 5/1925 | Stubbs | 40/642 |
| 2,875,515 | 3/1959 | Sieminski | 40/653 X |
| 3,236,576 | 12/1964 | Dawley . | |
| 3,294,461 | 12/1966 | Barnard et al. | 312/204 X |
| 3,677,570 | 7/1972 | Hedu | 40/308 X |
| 3,697,363 | 10/1972 | Martinez | 312/204 X |
| 4,229,921 | 10/1980 | Schell | 312/204 X |
| 4,247,158 | 1/1981 | Quayle . | |
| 4,261,122 | 4/1981 | LeVine | 312/204 X |
| 4,437,529 | 3/1984 | Fralish | 16/268 X |
| 4,732,431 | 3/1988 | Mason . | |
| 4,765,697 | 8/1988 | Gardell et al. . | |
| 4,993,783 | 2/1991 | Omholt | 312/234 X |

OTHER PUBLICATIONS

Assembly drawings A–D.

*Primary Examiner*—Kenneth J. Dorner
*Assistant Examiner*—Brian K. Green
*Attorney, Agent, or Firm*—Thomas J. Roth; Stephen D. Krefman; Thomas E. Turcotte

[57] ABSTRACT

An access panel arrangement is provided having one or more decorative panels, a frame for removably receiving those panels within a groove engaging a portion of the panel periphery, and a cover attached to the frame and movable between open positions in which the panels can be removed from the frame and closed positions in which the panels are restrained within the frame. The cover is attached to the frame by a plurality of tab and slot pairs, at least one of which is close fitting and provides lateral alignment of the cover to the frame. These tab and slot pairs are dimensioned to permit relative rotation such that the cover is hingedly connected to the frame in a free-floating manner. Snap fit latches are provided to retain the cover in a closed position, but are sufficiently resilient to release the cover and permit movement to an open position and a closed position in response to hand pressures without the use of tools. The frame also provides a snap fit or interlocking connection for a lower vent panel and is preferably integrally molded from plastic materials.

9 Claims, 2 Drawing Sheets

PLASTIC ACCESS PANEL FOR A DISHWASHER

BACKGROUND OF THE INVENTION

The present invention relates generally to automatic dishwashers and, more particularly, to access panel arrangements under the door of front loading automatic dishwashers.

Prior automatic dishwashers have typically included a front loading door and an access panel arrangement below and closely spaced from that door. The door often includes a large decorative panel, and the access panel arrangement often includes a matching, smaller decorative panel as well. One example of prior dishwashers having such a door structure is shown in U.S. Pat. No. 4,732,431, issued Mar. 22, 1988 and assigned to the assignor of the present invention. In that patent, interchangeable door panels 68, 70 and 72 are removably attached to door frame 30 by, for example, the snap fit arrangement shown therein at FIG. 5.

Prior access panel arrangements have also permitted use of interchangeable decorative panels, although with different structural arrangements. For example, frames have been provided having a groove or track therein for receiving three sides of a rectangular decorative panel. A cover over the fourth side of such panels was provided and attached to the frame by screws or other reusable fasteners. These fasteners required the use of tools in order to remove the cover from the frame so that the decorative panel could be changed. Further, in order to provide a finished and aesthetically pleasing appearance to the front of the dishwasher these fasteners were typically mounted on the side or top surfaces of the access panel arrangement. These locations, however, were often difficult to reach without specially formed tools unless the access panel arrangement itself was removed from the front of the dishwasher. Removing the access panel arrangement from the dishwasher is often undesirable, especially if done by consumers, because the electrical and mechanical components of the dishwasher would be more exposed to inadvertent contact with persons changing the decorative panel. Thus, prior access panel arrangements are considered less convenient and/or less safe than is desireable, especially for consumer use.

In designing improved access panel arrangements which permit changing of decorative panels, the structural and functional considerations are not identical with those of front loading door arrangements. The spacial constraints are, for example, an important factor. It is often desirable for the access panel to be closely spaced from the bottom edge of the door and generally flush with the front surface of the door to provide an aesthetically pleasing, integrated appearance. At the same time, the access panel arrangement itself should be readily removable and permit maximum utilization of the front access opening to facilitate servicing of the electrical and mechanical components of the dishwasher by trained service personnel. However, the decorative panel itself should be easily removable by consumers from the front of the dishwasher to avoid excessive servicing and to restrict consumer exposure to those electrical and mechanical components. Exposure to the dishwasher components under the tub could pose a safety hazard to unwary consumers and permit damage to the dishwasher operation.

In manufacturing access panel arrangements it is important to provide a secure and reliable structure at a minimal cost. Many prior arrangements have required a plurality of separately formed parts held together by various separate fasteners. Assembly of these components was time consuming and expensive. If attempts are made to decrease costs by minimizing the number of parts through, for example, molding the components into integral assemblies, extra attention was needed to control manufacturing tolerances so that the assemblies consistently fit together and fit with respect to other dishwasher elements.

It is, therefore, an object of the present invention to provide an improved access panel arrangement for automatic dishwashers.

Another object is the provision of an access panel arrangement having decorative panels which can be conveniently changed by consumers without the use of tools.

A further object is to provide an access panel arrangement which minimizes consumer exposure to electrical and mechanical components of the dishwasher while being easily removable by service personnel.

Yet another object is the provision of a simplified construction for access panel arrangements which permits reduced material, manufacturing and assembly costs without loss of reliability.

A still further object is to provide an access panel arrangement from components which can be snap fit together and maintain close tolerances without excessive manufacturing costs.

SUMMARY OF THE INVENTION

These and other objects of the present invention are obtained by the provision of an access panel arrangement having one or more decorative panels, a frame for removably receiving those panels within a groove engaging a portion of the panel periphery, and a cover attached to the frame and movable between open positions in which the panels can be removed from the frame and closed positions in which the panels are restrained within the frame. The cover is attached to the frame by a plurality of tab and slot pairs, at least one of which is close fitting and provides lateral alignment of the cover to the frame. These tab and slot pairs are dimensioned to permit relative rotation such that the cover is hingedly connected to the frame in a free floating manner. Snap fit latches are provided to retain the cover in a closed position, but are sufficiently resilient to release the cover and permit movement to an open position and a closed position in response to hand pressures without the use of tools. The frame also provides a snap fit or interlocking connection for a lower vent panel and is preferably integrally molded from plastic materials.

Other objects, advantages and novel features of the present invention will now become readily apparent upon consideration of this specification in light of the drawings included herewith.

DETAILED DESCRIPTION OF THE PREFERRED EMBODIMENTS

Figure 1:
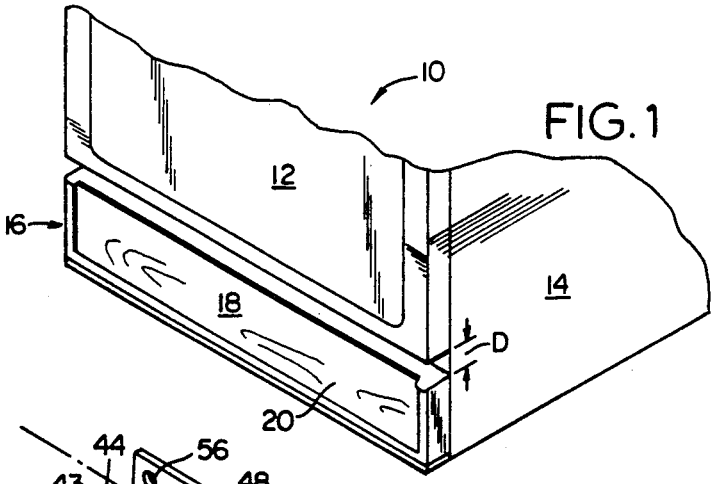
FIG. 1 shows a front right perspective view of a lower portion of a front loading automatic dishwasher incorporating the present invention.

FIG. 1, which illustrates utilization of a preferred embodiment of the present invention, shows a front loading automatic dishwasher 10 of, for example, an under the counter type, having a conventional hinged door 12 mounted to housing 14. Access panel assembly or arrangement 16 is typically mounted to dishwasher 10 below and spaced apart from door 12 by distance D, although front surface 18 of access panel arrangement 16 is preferably substantially flush with the front surface of door 12. Distance D is readily determined preferably by the minimum space necessary to permit door 12 to freely open and close and to permit the access panel arrangement to open to allow decorative panels to be removed, as described further below. Access panel arrangement 16 forms a front closure for the dishwasher and typically restricts access to electrical and mechanical components located below the dishwasher tub, such as the motor, pump, water valves, thermostats and wiring harness.

Access panel arrangement 16 includes a decorative panel 20, frame member 30, cover member 60 and, preferably, vent panel 80. Panel 20 is, for example, rectangular in shape and includes a decorative panel element 22 which is painted or otherwise colored differently on both sides, but matching and/or complimentary to the color of the decorative panel of door 12. If formed from sheet metal, a plurality of different panel elements 22 can be interchangeably mounted within frame 30 with only one side of the outermost panel element showing. A compressible spacer 24 is preferably provided to compensate for the variation in thicknesses of the panel element or elements used and to retain panel element or elements 22 securely within frame 30. Spacer 24 is, for example, formed from corrugated cardboard. Preferably, decorative panel 20 includes a single sheet metal panel element 22 and a single compressible spacer 24, although frame 30 can, if desired, include several interchangeable sheet metal panel elements 22 as decorative panel 20 without use of spacer 24. Alternatively, the decorative panel can be formed as a wood panel 26 which is dimensioned thicker than one or more sheet metal panel elements 22 and can fit snugly within frame 30 with or without use of spacer 24.

Figure 3:
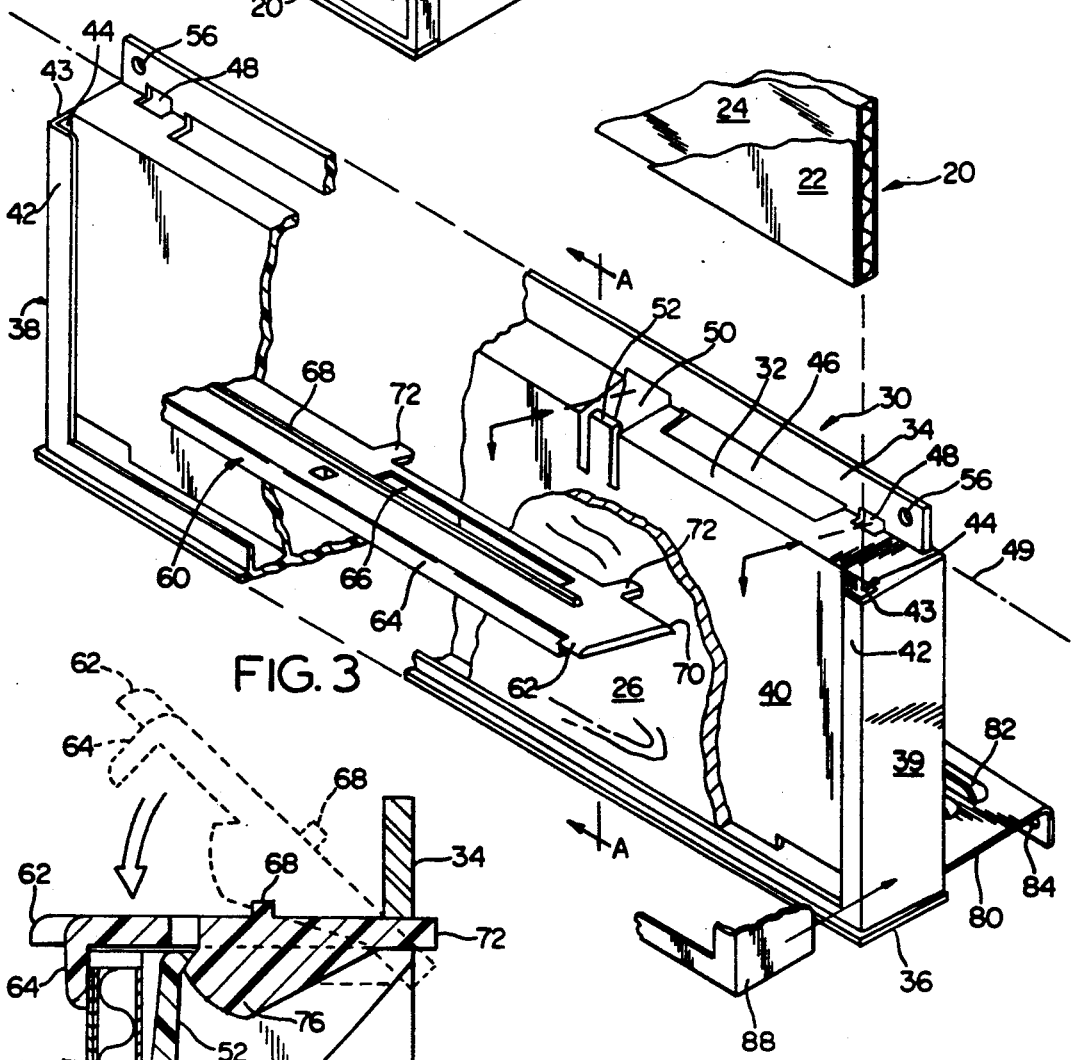
FIG. 3 shows an exploded, enlarged front right perspective view of the access panel arrangement of the present invention with the vent panel attached thereto and alterative decorative panel structures displayed.
Figure 2:
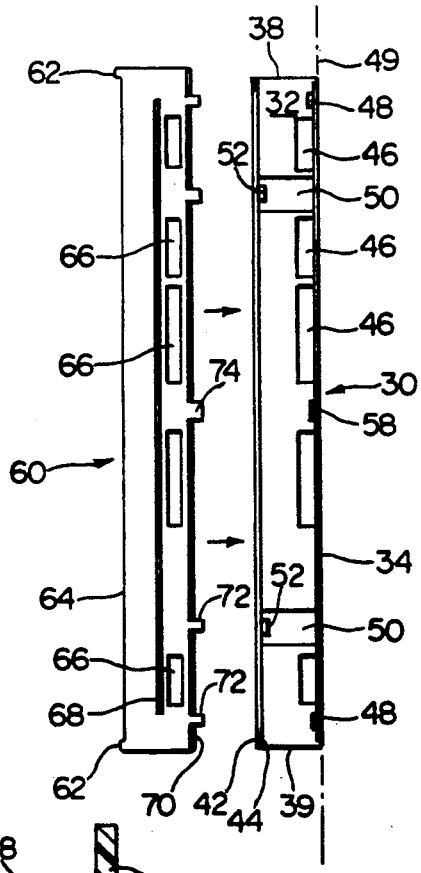
FIG. 2 shows a top view of the disconnected frame and cover members of the present invention.
Figure 4:
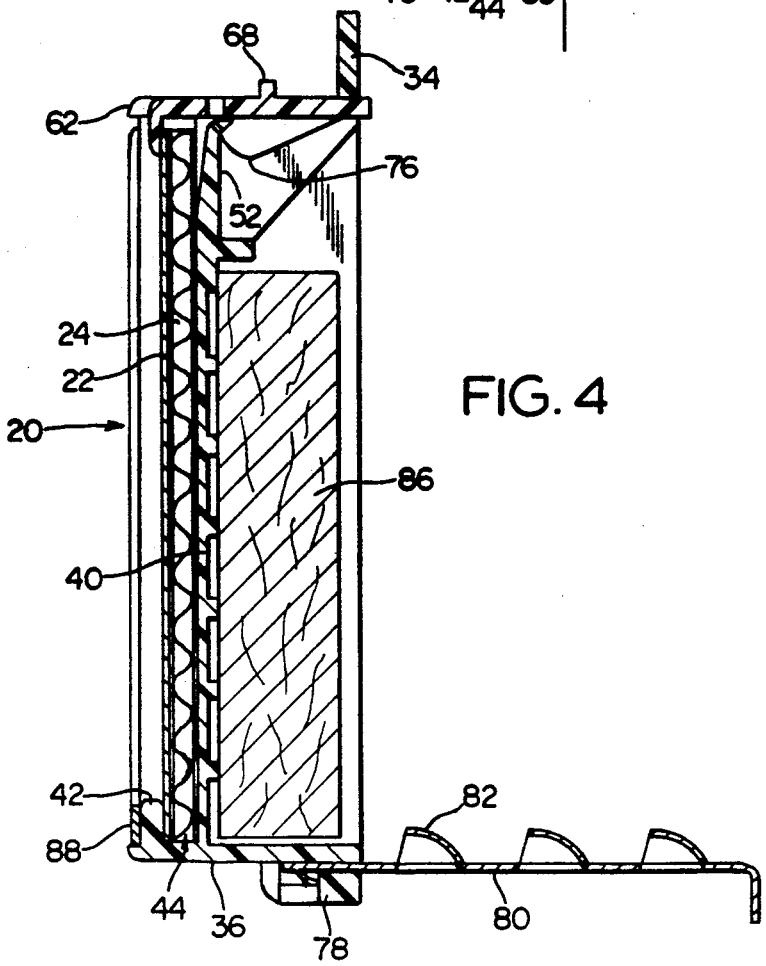
FIG. 4 shows a further enlarged cross-sectional view of the assembled access panel arrangement as taken along lines A—A of FIG. 3.

As shown in FIGS. 2, 3 and 4, frame member 30 includes top wall 32, top ledge 34 extending upwardly from the back of top wall 32, bottom wall 36, left and right side walls 38 and 39 connecting top wall 32 and bottom wall 36, and back wall 40 connecting top wall 32, bottom wall 36 and side walls 38 and 39. A peripheral, inwardly directed ledge 42 is provided along side walls 38 and 39 and bottom wall 36 and spaced apart therefrom by bight 43 so as to create a groove 44 within frame 30. The rectangular dimensions of panel 20 are preferably selected so as to closely fit within groove 44 with frame 30 restraining panel 20 along three of the peripheral sides of the panels. The width of groove 44 is selected so as to slideably receive at least one panel 26 and/or one or more panel elements 22 in combination with spacer 24. Back wall 40 supports panel 20 against inward movement toward the electrical and mechanical components of the dishwasher.

Top wall 32 includes one or more air flow openings 46 which permit circulation of air to the internal components of dishwasher 10. At the junction of top ledge 34 and top wall 32 a plurality of spaced apart connection slots 48 are formed along longitudinal axis 49. Slots 48 are cut out from portions of both top wall 32 and top ledge 34 so as to have both vertical and horizontal dimension. Top wall 32 also includes a plurality of latching cut out portions 50 spaced apart along the longitudinal length of top wall 32. Cut out portions 50 also extend vertically into top ledge 34 for a limited distance, as described further below. Back wall 40 includes a plurality of male latching arms 52 adjacent the junction of back wall 40 and top wall 32. Each arm 52 is aligned with a cut out portion 50. Top ledge 34 further includes, for example, two openings 56 at each end thereof for receiving separately formed fasteners, such as screws, to attach access panel arrangement 16 to dishwasher 10. Top wall 32 and top ledge 34 also include alignment slot 58 centrally located along axis 49 and formed with vertical and horizontal dimensions into those elements generally as slots 48 have except that the width of slot 58 along axis 49 is preferably greater than the width of any of slots 48.

Cover member 60 is generally flat and preferably extends longitudinally for just greater than the length of top wall 32 such that cover member 60 slightly overhangs frame 30 at side walls 38 and 39. Cover member 60 includes front projecting tabs 62 at each longitudinal end. Tabs 62 are dimensioned to overhang ledge 42 along side walls 38 and 39. The extent of that front overhang and the side wall overhang is selected so as to permit a consumer's fingers to adequately grip the tabs to raise cover member 60, but minimize unsightly disruption of the generally flush appearance of the access panel arrangement. For example, front and side overhangs of 3 mm have been found to be adequate.

Cover member 60 also includes front ledge 64, extending downwardly toward bottom wall 36. Ledge 64 generally corresponds with ledge 42 and, in combination with the front portion of cover member 60, covers the remaining peripheral edge of panel 20. Thus, when cover member 60 is in a closed position, panel 20 preferably has its entire periphery enclosed by the access panel arrangement with only the front surface of panel 20 being visible.

Cover member 60 also includes air flow openings 66 which are disposed to register with air flow openings 46 when cover member 60 is in a closed position. Raised ledge 68 is provided on cover member 60 in front of openings 66 to limit access to those openings by solid objects and debris.

Cover member 60 further includes inclined back edge 70 and a plurality of rearwardly extending tabs 72 spaced apart along back edge 70. Preferably, a single rearwardly extending alignment tab 74 is provided at the midpoint of back edge 70. Tabs 72 are, for example, spaced apart on either side of alignment tab 74. One of tabs 72 is insertable in each of connection slots 48 and the vertical extensions of cut out portions 50. The vertical dimension of slots 48 along top ledge 34 and of the vertical extensions of cut out portions 50 correspond closely with the thickness of tabs 72 so as to allow tabs 72 to be freely inserted therein with some excess spacing. However, precise dimensional correspondence of tabs 72 and slots 48 and cut out portions 50 is not necessary with the present invention. The widths of slots 48 and cut out portions 50 along axis 49 in particular can be even twice as wide as tabs 72. In the present invention tabs 72 assist in preventing removal of cover member 60 from frame 30, but proper alignment of cover member 60 with respect to frame 30 is primarily the function of alignment tab 74 and slot 58.

Close tolerances are preferably maintained between alignment tab 74 and slot 58 both in terms of the width along axis 49 and the vertical extension into top ledge 34 with respect to the thickness of alignment tab 74. In each respect alignment tab 74 should fit snugly and with minimal excess space in slot 58. With respect to the horizontal extension of slot 58 into top surface 32, that extension can be slightly less than the thickness of alignment tab 74 because in the fully open position of cover member 60 ledge 68 will generally prevent cover member 60 from reaching a fully vertical orientation. Thus, cover member 60 will be gravitationally biased to a closed position.

Cover member 60 further includes a plurality of female latching arms 76 on its underside. Female latching arms 76 are located so as to be received in cut out portions 50 when cover member 60 is in a closed position. Female latching arms 76 are also located so as to register and interlock with male latching arms 52 when cover member 60 is fully closed. Preferably, male latching arms 52 are flexible so as to permit snap fit latching or interlocking (as well as unlatching) by consumers without use of tools. At the same time, latching arms 52 and 76 should be sufficiently secure when interlocked that cover member 60 does not rattle or come loose during dishwasher operation.

Frame member 30 also can include snap fit or interlocking connector 78 on bottom wall 36 to secure vent panel 80 to the access panel arrangement. However, the interlocking of vent panel 80 to frame member 30 is preferably more secure than that of frame member 30 to cover member 60. Since it is usually not necessary to remove vent panel 80 from frame member 30 the snap fit of connector 78 may advantageously require the use of tools or permanent deformation of frame member 30 to secure and/or release vent panel 80. Alternatively, vent panel 80 can be integrally formed as an extension of bottom wall 36. Vent panel 80 includes, for example, a plurality of lower air vents 82 to permit air circulation to internal dishwasher components and two openings 84 at each end thereof for receiving separately formed fasteners, such as screws, to attach access panel arrangement 16 to dishwasher 10. Further, frame member 30 can, for example, include insulation block 86 on the back side of the back wall 40 to reduce the noise and vibration perceptible to consumers and include decorative trim 88 attached by adhesive to front surface 18 at ledge 42 and/or sides 38 and 39.

In its fully assembled form, preferred embodiments of the present invention are attachable to dishwasher 10 through four separately formed fasteners connecting at openings 56 and 84. However, no separately formed fasteners are needed to assemble the access panel arrangement itself. Thus, no tools are needed to assemble the access panel arrangement and, due to the relative flexibility of interlocking latching arms 52 and 72, no tools are needed to open cover member 60 or move it relative to dishwasher 10 once access panel arrangement 16 is attached to dishwasher 10. The present invention permits the access panel arrangement to continue to serve as a closure to restrict access to dishwasher components below the tub without preventing changing of decorative panel 20.

The access panel arrangement of the present invention is preferably formed from only two separately molded plastic parts, the frame and cover members. Since only tab 74 and slot 58 need control relative alignment and these features are centrally located, the manufacturing tolerances of the other tab and slot pairs connecting the cover and frame members are not critical and shrinkage problems can be minimized (if the frame and cover members are formed from molded plastic), resulting in the availability of less costly manufacturing processes.

Figure 5:
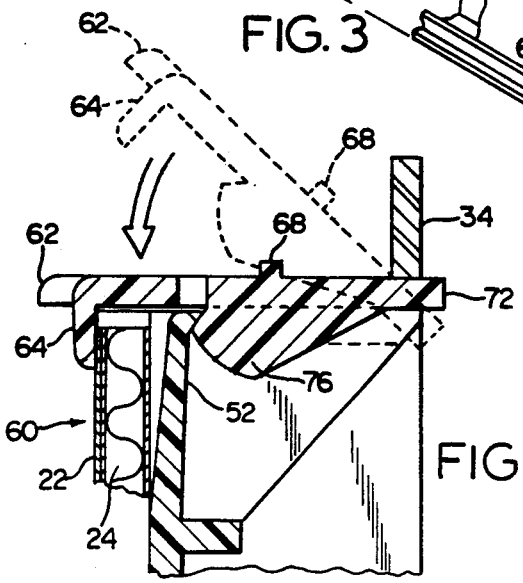
FIG. 5 shows a further enlarged cross-sectional view of a portion of the assembled access panel arrangement of FIG. 4, illustrating the hinged motion of the cover member relative to the frame member.

Once installed, cover member 60 is rotatable or pivotable upward in slots 48 and 58 about axis 49 at the junction of top ledge 34 and top wall 32, as shown in FIG. 5, by snapping cover member 60 off of latching arms 52. When cover member 60 is pivoted upward to an open position ledge 64 no longer retains panel 20. These panels can then be slid upwardly out of groove 44 for removal, replacement, or reversal of sides. When the desired reorientation of panel 20 is achieved, cover member 60 pivots downwardly to a closed position where it is snap fit back onto latching arms 52. Thus, cover member 60 is, in effect, hinged to frame member 30 at the junction of top wall 32 and top ledge 34, although that "hinge" is free floating to some extent since cover member 60 can be readily completely removed by pulling tabs 72 and 74 out of their respective slots in frame member 30.

Although the present invention has been described above in detail, the same is by way of illustration and example only and is not to be taken as a limitation of the present invention to only the specific embodiments referred to herein. The spirit and scope of the present invention are intended to be limited only by the terms of the following claims.

What is claimed is:

1. An automatic dishwasher and an access panel arrangement, said access panel arrangement positioned beneath and flush with a door of said automatic dishwasher, and secured to said dishwasher, said access panel arrangement further comprising:

a frame member for removably receiving said decorative panel, said frame member having a flat wall, said flat wall facing upwardly when said access panel arrangement is attached to said dishwasher, said flat wall having a front edge and a rear edge; and a cover member removably secured to said flat wall of said frame member without separate fastener elements, said cover member having a portion projecting forwardly of said front edge of said flat wall, said cover member being pivotally mounted to said frame member and movable with respect to said frame member about an axis defined by the rear edge of said flat wall between open and closed positions, and said decorative panel being removable from said frame member when said cover member is in said open position and restrained against removal from said frame member when said cover member is in said closed position.

2. The access panel arrangement according to claim 1 wherein said cover member is movable between said open and closed positions without the use of tools.

3. The access panel arrangement according to claim 1 wherein said cover member and said frame member include at least one pair of closely interfitting tab and slot elements for attaching said cover member to said frame member.

4. The access panel arrangement according to claim 3 wherein said tab and slot elements are dimensioned to restrict relative lateral movement while permitting relative rotational movement.

5. The access panel arrangement according to claim 1 wherein said cover member attaches to said frame member at an upper portion of said frame member and moves toward said door in said open position.

6. The access panel arrangement according to claim 1 also including a vent panel attached to said frame member without separate fastener elements.

7. The access panel arrangement according to claim 1 wherein said frame member includes a groove means for receiving and retaining a first portion of a peripheral edge of said decorative panel and said cover member includes a ledge means for retaining a second portion of the peripheral edge of said decorative panel in combination with said frame member when said cover member is in said closed position.

8. The access panel arrangement according to claim 7 wherein said frame member includes a back wall means for supporting said decorative panel when said decorative panel is received within said groove means.

9. The access panel arrangement according to claim 1 wherein said frame member and said cover member include interengaging snap fit elements to retain said cover member in said closed position.

* * * * *